United States Patent [19]

Scott

[11] 4,164,978

[45] Aug. 21, 1979

[54] OIL EXTRACTION METHOD

[75] Inventor: Harold W. Scott, Ridgefield, Conn.

[73] Assignee: Winton Corporation, Ridgefield, Conn.

[21] Appl. No.: 879,484

[22] Filed: Feb. 21, 1978

[51] Int. Cl.[2] ..... E21B 43/25

[52] U.S. Cl. ..... 166/249; 166/65 R; 166/177

[58] Field of Search ..... 166/249, 299, 65 R, 166/177; 175/16; 299/14

[56] References Cited

U.S. PATENT DOCUMENTS

| | | | |
|---|---|---|---|
| 2,756,826 | 7/1956 | Ebaugh | 166/299 |
| 3,123,546 | 3/1964 | Bodine | 299/14 X |
| 3,180,418 | 4/1965 | MacLeod | 166/65 R X |
| 3,422,894 | 1/1969 | Brandon | 166/249 |
| 3,497,005 | 2/1970 | Pelopsky et al. | 166/249 X |
| 3,503,446 | 3/1970 | Brandon | 166/249 |
| 3,718,186 | 2/1973 | Brandon | 166/249 X |
| 3,990,512 | 11/1976 | Kuris | 166/249 |
| 4,060,128 | 11/1977 | Wallace | 166/249 |

FOREIGN PATENT DOCUMENTS

| | | | |
|---|---|---|---|
| 1175187 | 12/1969 | United Kingdom | 166/249 |

*Primary Examiner*—Stephen J. Novosad
*Assistant Examiner*—George A. Suchfield

[57] ABSTRACT

A method is provided for recovering oil from an oil bearing earth formation by means of electrohydraulic shock waves generated in a liquid by capacitor electrical discharge means and supplemented with ultrasonic waves.

4 Claims, 2 Drawing Figures

OIL EXTRACTION METHOD

BACKGROUND OF THE INVENTION

This invention relates to a method for recovering oil from an oil bearing strata by means of the generation of shock waves and ultrasonic waves in a liquid in the bearing earth strata.

As used in this specification, the term "oil" means natural oil or petroleum as found in nature particularly in oil bearing earth formations. Such a product is often called "crude oil" which consists principally of hydrocarbons.

The removal of oil by the use of drilled oil wells in the oil bearing formation has been practiced for several generations. Many of the wells have ceased to be utilized because it is not economical to remove by conventional methods the oil which remains in the formation. To remove the oil which is left behind, such oil being called "residual oil", it has been suggested to use various techniques. The primary technique is to flood the well with water in order to induce further flow. In addition to water flooding, other techniques have been developed such as the injection of liquified petroleum gas, solvents, or surfactants into the well, usually before the water flooding occurs.

In addition, it has been suggested to use a thermal explosion at the bottom of the well, hopefully to cause additional fissures in the oil bearing formation so as to increase the oil flow. Obviously, thermal explosions have the disadvantage of destroying the well and, also, of having a limited effect if they are to be kept from destroying the well.

In my copending applications Ser. No. 502,661, filed Sept. 3, 1974, and Ser. No. 863,434, filed Dec. 22, 1977, the use of electrohydraulic shock waves generated by capacitor discharge means is disclosed.

It is an object of the present invention to provide a method for recovering oil from an oil bearing formation which is an improvement beyond that disclosed in my copending applications.

It is a further object of the present invention to provide a method which can be easily and efficiently carried out in a well with a minimum of shut down time of well operations.

It is another object of the present invention to provide a recovery method which is economical in operation.

SUMMARY OF THE INVENTION

By the present invention a method is provided for recovering oil from an oil bearing earth formation by means of electrohydraulic shock waves and ultrasonic waves generated in a liquid in the well. The shock wave is achieved by means of capacitor electrical discharge means and the ultrasonic waves by an ultrasonic generator.

By the present method liquid in the well preferably either in the form of water or oil forms and transmits the shock wave which moves through the liquid until it meets an interface with another material which will usually be rock or densely packed soil. At the point of interface, the shock wave will then reduce the tension which exists between the oil contained in the formation and increase its flow into the well area. In addition, the shock wave will cause further fissures in the surrounding area providing further channels for flow of oil released from the bearing soil. After the shock wave has had its effect, an ultrasonic wave is generated in the liquid generating a repetitive force particularly in liquid in the fissures created by the shock wave, thus freeing still more held oil from the formation.

In cases where the shock wave is utilized in combination with a water flood the increased fissures will permit further areas for the water flood to fill and thus improve the oil flow.

The apparatus used to carry out the present invention primarily consists of capacitor electrical discharge means which is connected to a power source and to a shock wave generator and an ultrasonic generator which consists of an electromechanical transducer and a high frequency electric power supply.

DESCRIPTION OF THE ILLUSTRATED EMBODIMENT

Figure 1:
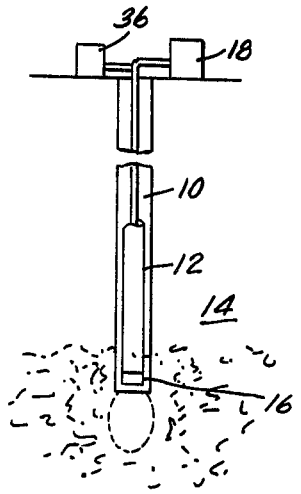
FIG. 1 is a diagramatic view of a well showing apparatus for carrying out the present invention in position therein.

Referring to the drawings and to FIG. 1 in particular, a wellhole 10 with a well casing 12 therein is shown in place in an oil bearing earth formation 14. This is the usual combination which is found in most oil well drilling and pumping operations. Positioned at the lower end of the well casing is a shock wave generator 16. This generator, in turn, is connected to an energy storage capacitor bank 18.

Figure 2:
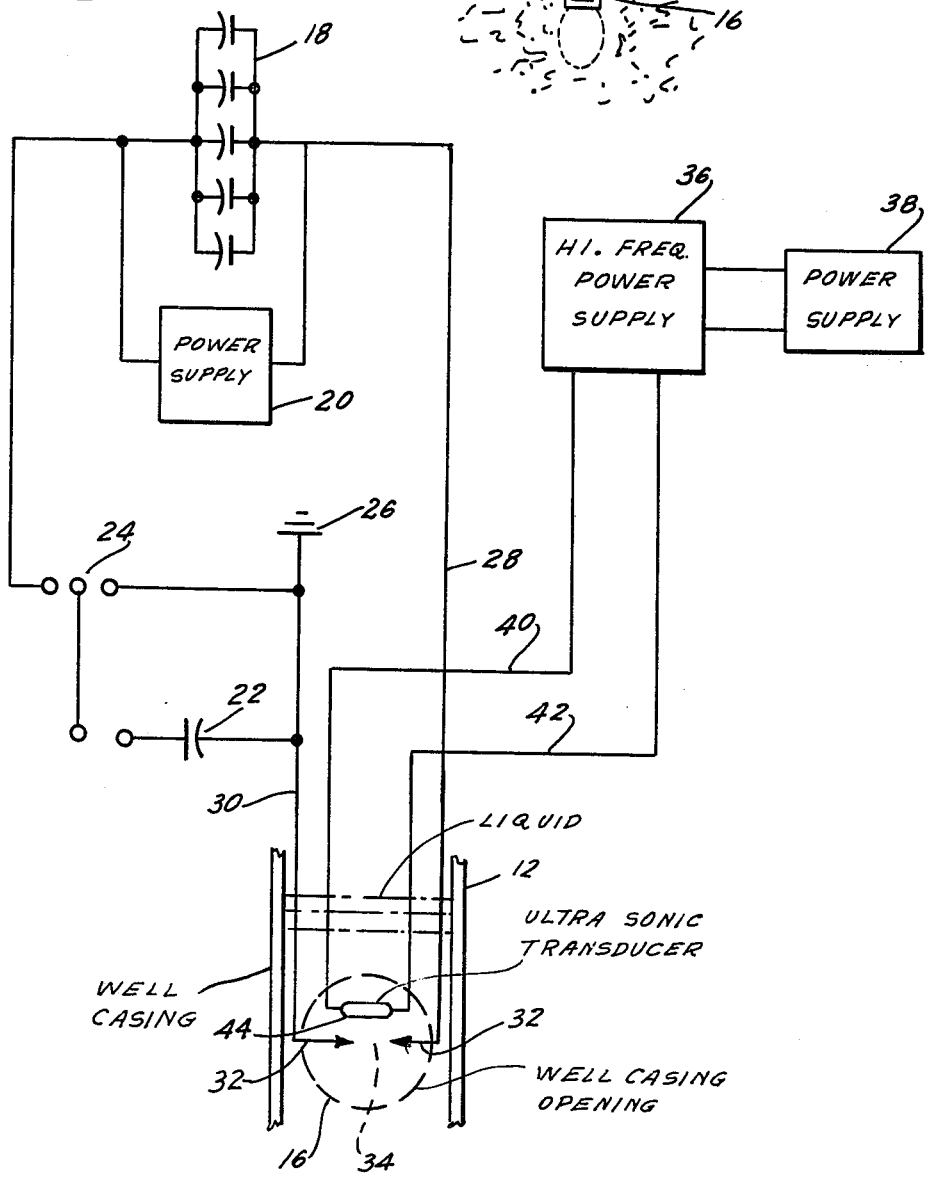
FIG. 2 is a diagramatic view of the apparatus for carrying out the present invention.

Referring to FIG. 2 the diagramatic operation of the shock wave generator and capacitor bank will provide an understanding of the apparatus used in that portion of the method of the present invention. An electrical power supply 20 is connected to a main energy storage capacitor bank 18 which, in turn, is connected to a trigger switch 22 and a main three electrode switch 24. Since the system will use direct current voltage, the unit is also connected to a ground 26. The shock wave generator 16 is connected to the energy storage capacitor bank 18 by means of leads 28 and 30. Lead 30 is connected to the capacitor bank 18 through the trigger switch 22 and the main switch 24.

When in operation the power supply is connected to the energy storage capacitor bank until the bank has been sufficiently charged. At that point the trigger switch 22 is closed and this, in turn, causes the main three electrode switch 24 to arc over releasing the energy stored in the capacitor bank to the shock wave generator. Since the shock wave generator is placed within the wellhole 10 and a liquid L is in it, the shock wave generated by the generator will be imparted to the liquid L causing an electrohydraulic shock wave. The discharge from the capacitor bank 18 last but a few millionths of a second and the resulting shock wave is a severe one. Shock waves caused in this manner are known in other arts such as in metal forming wherein a shock wave so generated has been sufficient to die form a metal plate by the generated force.

In my aforesaid patent application Ser. No. 863,434 a shock wave generator is described in detail wherein a pair of spaced apart electrodes 32 form a spark gap 34.

The ultrasonic wave is produced by means of a high frequency power supply 36 which is connected to a constant power supply 38 such as standard line current.

The high frequency power supply is connected by leads 40 and 42 to an ultrasonic transducer 44 which is in the wellhole in the liquid L in the same region as the spark gap 34.

After the electrohydraulic shock waves have been generated, the ultrasonic waves are generated in the liquid preferably at a lower frequency of 20 kHz, or if necessary even lower, to create a cavitational shock intensity of substantial brute force.

Such ultrasonic created cavitation is well known and used in the application of cleaning manufactured parts.

As far as the present invention is concerned, the design of the particular ultrasonic generator will be determined by the desired cavitational effect needed in the particular earth formation being worked.

The shock wave generator and the ultrasonic transducer in order to function properly must be positioned at the proper desired elevation in the wellhole. This may be accomplished by any desirable detection means which will usually be operated through a control panel. One type of detector is shown in my aforesaid application Ser. No. 863,434.

The combination of electrohydraulic shock waves generated in a liquid by capacitor electrical discharge means and ultrasonic waves creating a cavitational shock wave gives a synergistic result. The electrohydraulic shock wave gives the initial impact to the formation freeing some entrapped oil and creating added fissures in the formation. The added ultrasonic waves with the cavitational shock waves causes still more oil to be released. Without the fissures caused by the electrohydraulic shock waves the ultrasonic waves would have a restricted zone of penetration into the formation about the wellhole. However, the combination of the two gives the ultrasonic a greater zone in which to function. As a result, the ultrasonic created cavitation has a greater effect than would normally be expected because its influence is extended through the fissures.

After the oil is separated from the oil bearing formation it is removed from the wellhole by any conventional means such as pumping.

While the present method has been described with the illustrated embodiment as firing through a well casing opening, it is to be understood that if desired the firing may be positioned below the well casing and fired at that level.

What is claimed is:

1. A method of recovering oil from a wellhole in an oil bearing earth formation comprising: generating an electrohydraulic shock wave in a liquid in said wellhole by capacitor discharge means; directing the generated shock wave outwardly through the liquid, from the wellhole and into the oil bearing formation to cause oil in said formation to be separated therefrom; generating an ultrasonic wave in said liquid in the region where the electrohydraulic shock wave was generated to further cause oil in said formation to be separated therefrom, and removing the separated oil through the wellhole.

2. A method as defined in claim 1 wherein the capacitor discharge means includes a spark gap apparatus.

3. A method as defined in claim 1 wherein the ultrasonic wave induces cavitation in the liquid in the wellhole.

4. A method as defined in claim 1 wherein the capacitor discharge means includes a spark gap apparatus and the ultrasonic wave induces cavitation in the liquid in the wellhole.

* * * * *